United States Patent [19]

Callihan et al.

[11] 4,413,682

[45] Nov. 8, 1983

[54] METHOD AND APPARATUS FOR INSTALLING A CEMENTING FLOAT SHOE ON THE BOTTOM OF A WELL CASING

[75] Inventors: Rudy B. Callihan, San Antonio; Clyde Wainwright, McQueeney, both of Tex.

[73] Assignee: Baker Oil Tools, Inc., Orange, Calif.

[21] Appl. No.: 385,614

[22] Filed: Jun. 7, 1982

[51] Int. Cl.[3] ..... E21B 33/14; E21B 34/08

[52] U.S. Cl. ..... 166/382; 166/328; 166/217; 166/242; 166/386

[58] Field of Search ..... 166/382, 327, 328, 242, 166/217, 386, 285, 290, 322

[56] References Cited

U.S. PATENT DOCUMENTS

| | | | |
|---|---|---|---|
| 2,179,017 | 11/1939 | Pieper | 166/327 X |
| 3,006,415 | 10/1961 | Burns et al. | 166/327 X |
| 3,159,219 | 12/1964 | Scott | 166/328 X |

*Primary Examiner*—Ernest R. Purser
*Assistant Examiner*—Michael Starinsky
*Attorney, Agent, or Firm*—Norvell & Associates

[57] ABSTRACT

A method and apparatus are provided for effecting the replacement of a cementing float shoe on the bottom of a well casing. A casing extension sleeve defines an upwardly facing locating shoulder and a seal bore adjacent such shoulder. A new or replacement float shoe is run into the well casing on the end of a tubular workstring and seated on the locating shoulder with an external seal engaging the casing seal bore. A plurality of radially expandable slip elements are provided in the replacement unit at a position above the external seal and such slips are retained in a retracted position by a retaining sleeve. Connection of the replacement cementing shoe to the workstring is achieved through a coupling sleeve having a threaded engagement with the replacement shoe and also being connected to the retaining sleeve. After seating of the replacement shoe, initial rotation of the workstring in a first direction will produce a partial unthreading of the coupling sleeve and an axial displacement of the retaining sleeve, thus freeing the slips to radially expand into engagement with the casing wall. Upward movement of the workstring will effect the setting of the slips. Further rotation of the tubular workstring will effect the complete disengagement of the coupling sleeve, permitting the workstring, coupling sleeve and retaining sleeve to be withdrawn from the well with the replacement cementing float shoe unit sealingly secured in the bottom of the well casing.

8 Claims, 5 Drawing Figures

METHOD AND APPARATUS FOR INSTALLING A CEMENTING FLOAT SHOE ON THE BOTTOM OF A WELL CASING

BACKGROUND OF THE INVENTION

1. Field of the Invention

The invention relates to a method and apparatus for effecting the installation or replacement of a cementing float shoe, normally run into a well on the bottom of the well casing, without requiring the removal of the well casing from the well.

2. Description of the Prior Art

It is a common procedure in the completion of subterranean wells to effect the cementing of the bottom portions of the well casing in the well bore. Such cementing operations are normally conducted, at least insofar as a first cementing stage is concerned, by passing cement axially through a cementing float shoe which is carried into the well on the bottom of the casing and incorporates a conventional float valve to accommodate a required upward passage of well fluids during the insertion of the casing. It occasionally happens that after insertion of the casing, it is found that the well bore is not completed to the proper depth. Obviously, the withdrawal of the entire casing string, particularly when welded joints have been employed, is a time consuming and expensive procedure. Heretofore, the problem of casing removal had only been partially solved by drilling out the cementing float shoe valve apparatus, then inserting an expanding type drill to complete the well bore to the desired depth. This procedure however, meant that the cementing operation had to be conducted without the benefit of an inplace cement float valve at the bottom of the well casing.

SUMMARY OF THE INVENTION

This invention provides a method and apparatus for effecting a reliable, sealed securement of a cementing float valve in the bottom of a well casing either as an original installation, or as a replacement after the original cementing float valve has been drilled out in order to permit further drilling or completion operations on the well bore. The casing extension sleeve containing the originally installed cementing float valve is provided with an upwardly facing locating shoulder above the position of the cementing float valve and a seal bore is provided immediately below the locating shoulder. A replacement cementing float shoe is then provided comprising nested inner and outer sleeve elements connected by an annular layer of cement. The lower portions of the cementing layer support a conventional cementing float valve. The outer sleeve is provided with a downwardly facing locating shoulder and an external seal which respectively cooperate with the locating shoulder and seal bore provided in the casing extension sleeve when the replacement cementing float shoe is run into the casing on a tubular workstring. The upper end of the inner sleeve is provided with threads which in turn cooperate with external threads provided on a coupling sleeve which is secured in conventional fashion to the bottom of a tubular workstring. Thus the replacement float shoe apparatus may be run through the casing and positioned in sealing relationship with the casing bore, following which the tubular workstring may be disengaged from the installed float shoe apparatus by rotation in a direction opposite that of the direction of the threads. Obviously the casing may be run in with no float shoe installed and the replacement shoe installed as the original.

To effect the securement of the installed float shoe apparatus to the casing extension sleeve, an annular recess is provided in the outer wall of the outer sleeve of the replacement float shoe and such recess is provided with an downwardly and outwardly inclined bottom surface. A plurality of annular segment slips are then mounted in peripherally spaced relationship in the recess and such slips have bottom surfaces sloped to correspond with the bottom surface of the recess so that upward relative movement of the replacement float shoe apparatus with respect to the slips will effect a radial outward displacement of the slips into wedging engagement with the adjacent bore surface of the casing extension sleeve. Resilient means are provided urging the slips radially outwardly and, in order to permit the passage of the slips through the casing, a retaining sleeve is provided in surrounding relationship to the slips to maintain the slips in a radially retracted position. The retaining sleeve is mounted for axial comovement with the coupling sleeve.

Accordingly, an initial rotation of the workstring results in rotation of the coupling sleeve and an upward axial displacement of the coupling sleeve with respect to the replacement cement float shoe apparatus, thus elevating the retaining sleeve out of engagement with the slip elements which are urged outwardly by their spring biasing means to engage the wall of the casing sleeve extension. Since the coupling sleeve is still partially engaged with the internal threads of the inner sleeve of the float shoe apparatus, an upward force can be applied through the tubular workstring to the replacement cement float shoe apparatus to force the slips outwardly into gripping engagement with the casing sleeve extension wall. Further rotational movement of the coupling sleeve by the tubular work string will result in the disengagement of the coupling sleeve from the replacement float shoe apparatus, leaving the replacement apparatus sealingly secured to the bottom of the casing extension sleeve and hence, the replacement cement float valve is ready to be utilized for subsequent cementing operations.

DESCRIPTION OF THE PREFERRED EMBODIMENTS

Figure 1:
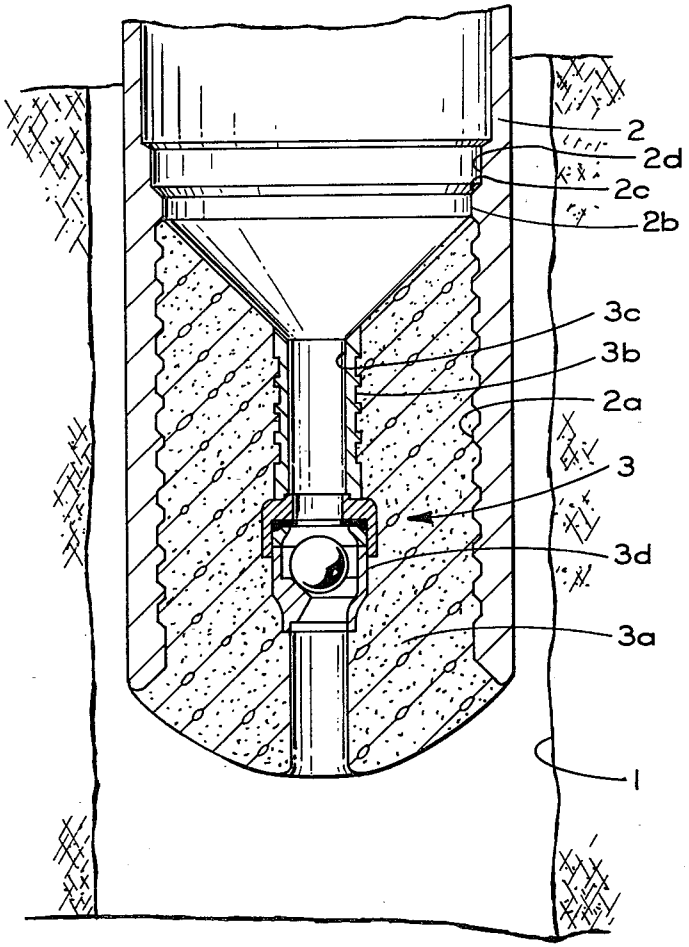
FIG. 1 is a vertical sectional view of a conventional cement float shoe initially installed in the bottom of a well casing extension sleeve, which sleeve is constructed in accordance with this invention.

Referring to FIG. 1, there is shown a well bore 1 in the bottom of which is disposed the bottom portions of a casing sleeve extension 2 which mounts a conventional cement float shoe 3. The cement float shoe 3 comprises an annular mounting layer of cement 3*a* which is adhered to an internally corrugated or threaded portion 2*a* of the bore of the casing sleeve extension 2. The cement float shoe 3 incorporates an inner sleeve 3*b* defining a seal bore 3*c* for reception of the seals of a drill pipe for subsequent cementing operations. Directly below the inner sleeve 3*b* there is provided a conventional float valve 3*d*.

Immediately above the cementing layer 3*a* of the cement float valve 3 the casing extension sleeve 2 is provided with an inwardly projecting rib 2*b* defining an upwardly facing locating shoulder 2*c*. Immediately above the locating shoulder 2*c*, a seal bore 2*d* is defined. It should be noted that the seal bore 2*d* is of greater internal diameter than the cement retaining corrugations 2*a* so that the drill out of the conventional cement float shoe 3 can be accomplished without damage to the seal bore 2*c*.

If it happens that the casing extension sleeve 2 cannot be lowered to the desired depth in the well bore 1, due to unconsolidated hole conditions, the utilization of the method and apparatus of this invention will permit further drilling of the well bore 1 and the replacement of any conventional cement float shoe apparatus on the bottom end of the casing extension 2 without requiring the pulling of the casing from the well.

Figure 2:
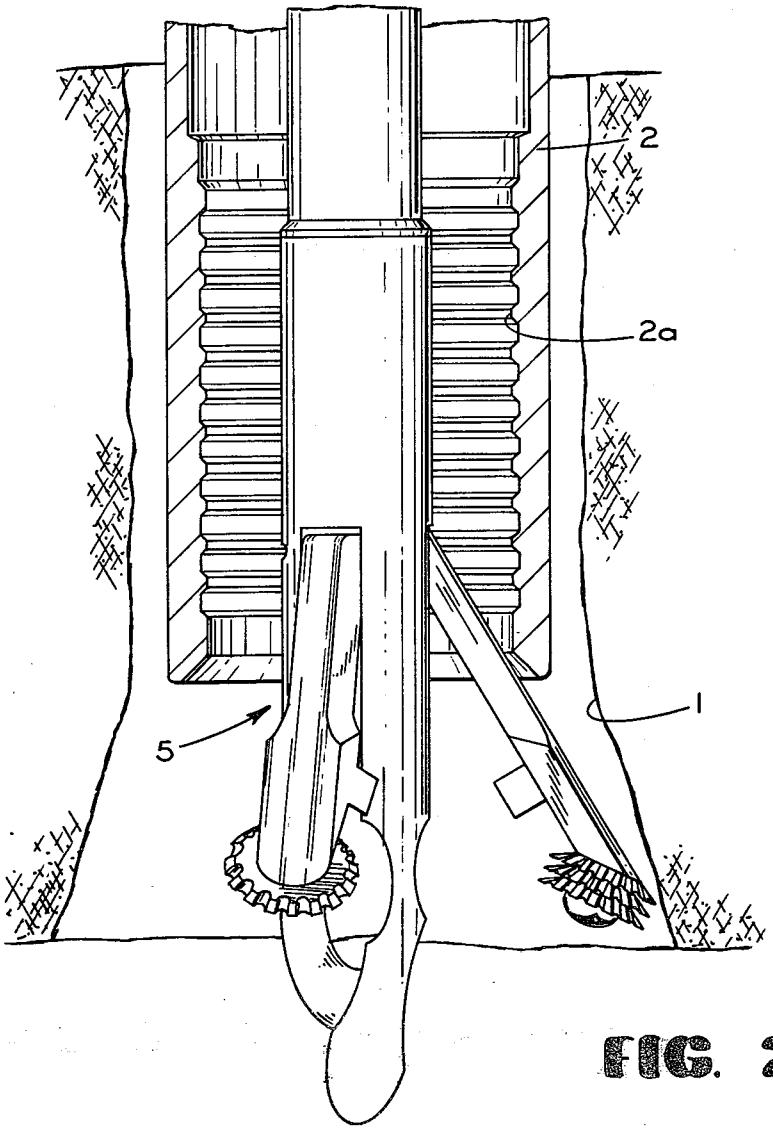
FIG. 2 is a view similar to FIG. 1 but illustrating the drilling out of the originally installed cement float shoe and the further drilling of the well bore below the bottom of the casing extension sleeve through the utilization of a conventional underreamer.

The first step of the procedure is illustrated in FIG. 2 wherein a conventional underreamer 5 is insertedin the well casing and effects the drilling out of the internal components of the originally installed cement float shoe 3, following which the underreamer 5 may be extended through the bottom of the casing extension sleeve 2 to drill the well bore 1 to whatever depth is required. The underreamer 5 is then removed from the casing. Alternatively, the sleeve 2, may be run in the well with no float shoe installed.

Figure 3:
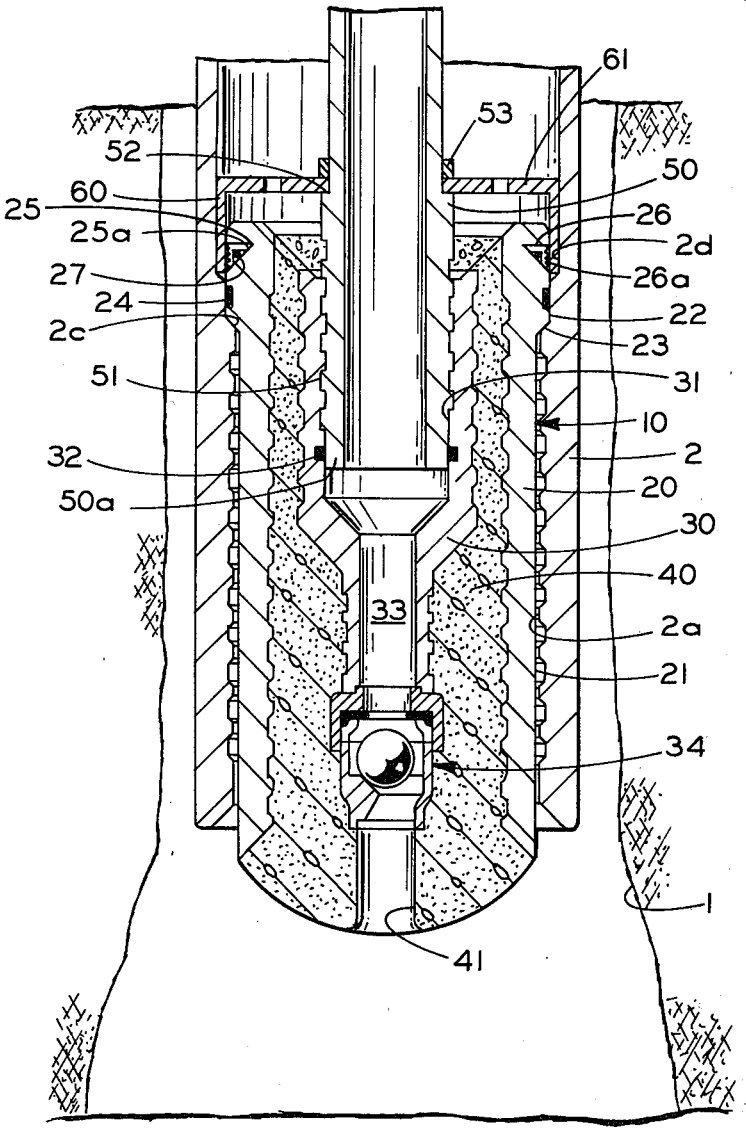
FIG. 3 is a view similar to FIG. 1 but illustrating the first step in the installation of a replacement cement float shoe apparatus constructed in accordance with this invention.

Referring now to FIG. 3, the next step in the procedure is to run in a tubular workstring (not shown) carrying a replacement cement float shoe apparatus 10 and sealingly securing the replacement cement float shoe apparatus 10 in the bottom portion of the casing sleeve extension 2.

The replacement cement shoe apparatus 10 comprises a rigid nested assemblage of an outer sleeve 20, an inner sleeve 30 and an intermediate annular layer of cement 40. Inner sleeve 30 has the upper portion of its bore formed with internal lefthand square threads 31. These threads cooperate with corresponding external square threads 51 provided on the bottom portion of a coupling sleeve 50, which has its upper end conventionally secured to the tubular workstring (not shown). An annular seal 32 provided in the inner wall of the inner sleeve 30 provides a sealing engagement with a cylinder end portion 50*a* of coupling sleeve 50. Coupling sleeve 50 further provides a mounting for a slip retaining sleeve 60, a radial flange 61 of which rests on an upwardly facing shoulder 52 and is secured in that position by a ring 53 secured to coupling sleeve 50. Thus the retaining sleeve 60 is co-movable with the coupling sleeve 50 insofar as axial movements are concerned.

Below the threads 31, inner sleeve 30 defines a reduced diameter seal bore 33 for the subsequent sealing reception of the end of a drill pipe. Below seal bore 33, a conventional cementing float valve unit 34 is mounted communicating with the axial bore 41 defined in the annular cement layer 40.

The outer sleeve 20 of the replacement cement shoe apparatus 10 is provided with a lower cylindrical exterior surface 21 which freely clears the cement adhering corrugations 2*a* provided in the casing sleeve extension 2. The upper portion of outer sleeve 20 is radially enlarged as indicated at 22 and thus defines a downwardly facing shoulder 23 which seats on the upwardly facing locating shoulder 2*c* provided below the seal bore surface 2*d* of the casing sleeve extension 2. An annular external seal 24 is provided on the enlarged diameter portion 22 and sealingly cooperates with the seal bore surface 2*d* provided in the casing extension sleeve 2.

Above the external seal 24, the outer sleeve 20 is provided with an annular recess 25 within which are mounted a plurality of annular segment slips 26. Recess 25 has an outwardly and downwardly inclined bottom surface 25*a* and the bottom surfaces of the slips 26 are similarly shaped. Thus, upward relative movement of the outer sleeve 20 with respect to the slips 26 will produce a radially outward wedging action on such slips. Slips 26 are normally biased outwardly by any conventional resilient means, such as a C-ring 27. The outer surfaces of slips 26 are provided with gripping teeth 26*a*.

All components of the replaceable float shoe 10 remaining in the well are preferably formed from drillable material to permit subsequent drill out. As shown in FIG. 3, the slips 26 are normally maintained in a radially inwardly retracted position by the annular wall of retaining sleeve 60. Thus, the assemblage may be readily inserted through the casing and the casing extension sleeve 2 with the slips being shielded from contact with the casing walls.

Figure 4:
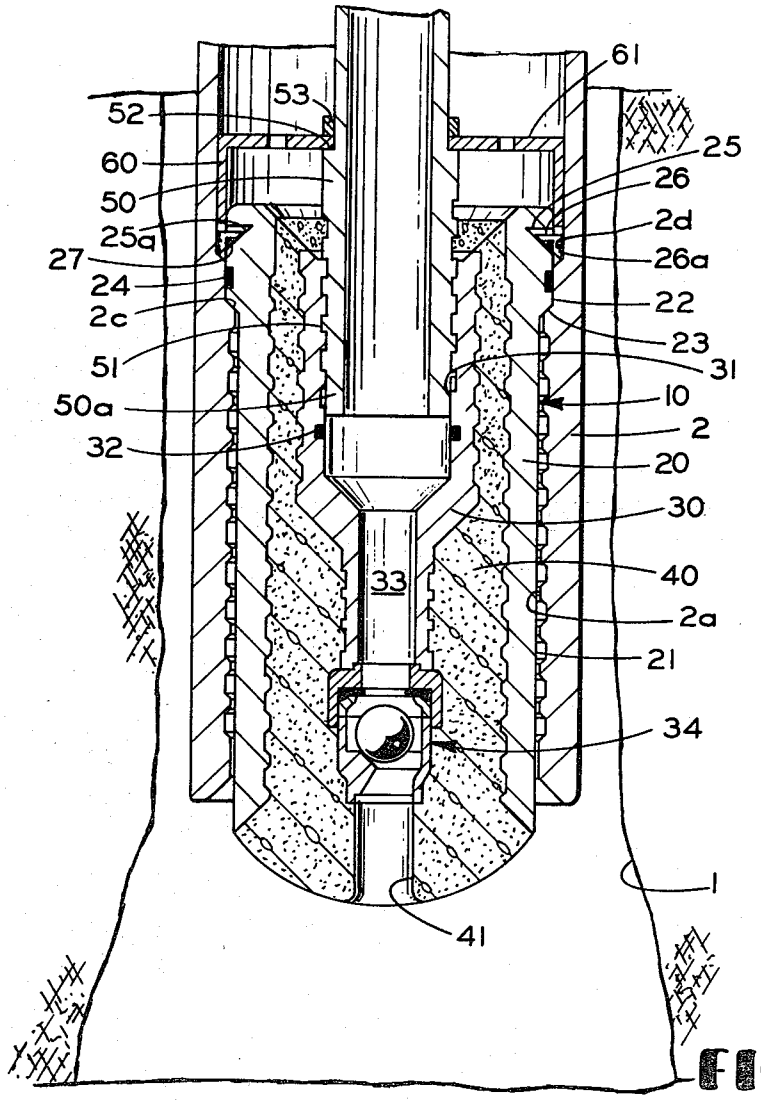
FIG. 4 is a view similar to FIG. 3 but illustrating the next step involved in the installation of the replacement cement float shoe apparatus.

After seating of the replacement cement float shoe apparatus 10 in the casing extension 2 in the manner illustrated in FIG. 3, the tubular workstring (not shown) is rotated clockwise for a few turns, but not sufficient to completely disengage the square threads of the coupling sleeve 50 from the inner sleeve 20. Such clockwise or righthanded rotation of the coupling sleeve 50 will result in an upward movement of the sleeve 50 relative to the cement float shoe apparatus 10 and hence will displace the retaining sleeve 60 in an upward direction and free the slips 26 to move radially outwardly into engagement with the adjacent wall of the casing extension sleeve 2, as shown in FIG. 4. The slips 26 may be further secured in their casing gripping position by applying an upward lifting force to the replacement cement shoe apparatus 10 through the workstring and the still connected coupling sleeve 50.

Following the securement of the slips 26, the workstring is rotated further in a clockwise direction sufficient to effect the complete disengagement of the coupling sleeve 50 from the replacement cementing shoe apparatus 10. The workstring with the coupling sleeve 50 and the retaining sleeve 60 attached thereto may then be removed from the casing.

The casing may then be moved downwardly to position the bottom end of the casing extension sleeve 2 at the desired distance above the new bottom of the well bore 1.

Figure 5:
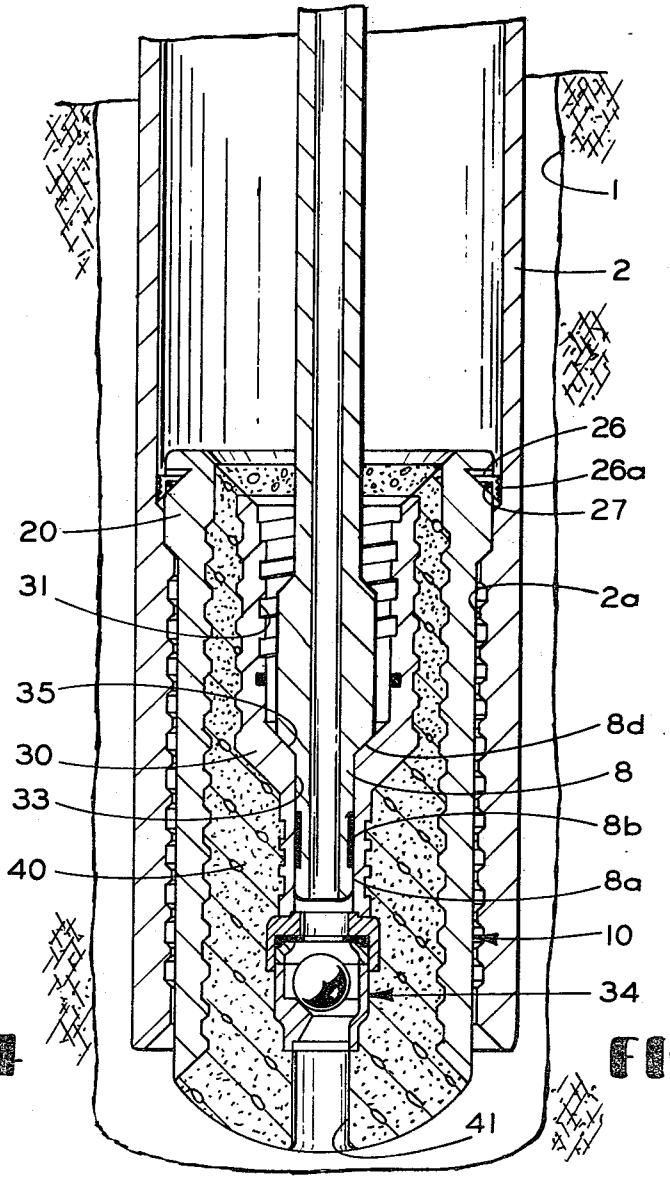
FIG. 5 is a view similar to FIG. 3 but illustrating the completed installation of the replacement cement float shoe and the stabbing in of a drill pipe preliminary to initiating cementing operations.

Referring to FIG. 5, a drill pipe 8 may then be inserted through the casing bore. The bottom end of drill pipe 8 is provided with a cylindrical sealing portion 8*a* incorporating external axially extending seal units 8*b* which sealingly engage the seal bore 33 defined in the lower portions of the inner sleeve 30. An external shoulder 8*d* provided on the lower portion of the drill pipe 8 seats on an upwardly facing internal shoulder 35 defined in the inner sleeve 30. The apparatus is then ready for the customary cementing operations with the cement being supplied through the drill pipe 8 and passing through the float valve 34 to flow axially out of the end of the replacement cementing float valve apparatus 10 and into the well bore 1.

Those skilled in the art will recognize that in some applications the original float valve may not be installed with the casing, in which case the casing sleeve extension 2 will be open and the replacement float shoe apparatus 10 will be installed as the first unit.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A replaceable float shoe apparatus for securement to the bottom of a well casing, comprising: a casing extension sleeve attachable at its upper end to the bottom of a well casing; inwardly projecting means in the bottom bore portions of said casing extension for cement adherence of a drillable float valve; a seal bore in said casing extension sleeve immediately above the position of the drillable float valve, said seal bore having a larger internal diameter than said inwardly projecting means, thereby permitting the drilling out of any cement adhered float valve without damage to said seal bore; an upwardly facing annular locating shoulder adjacent said seal bore; a replacement float shoe unit comprising a tubular housing containing a float valve, means in said tubular housing defining a threaded connection to a tubular workstring, an external locating shoulder on said tubular housing engagable with said upwardly facing annular locating shoulder in said sleeve when said tubular housing is run in on a tubular workstring; an external annular seal on said tubular housing engagable with said seal bore, radially expandable slip means on said tubular housing above said external annular seal, a retaining sleeve for holding said slip means in a radially retracted position, and means connecting said retaining sleeve for axial co-movement with the tubular workstring, whereby rotation of the tubular workstring in the direction opposite the direction of the threads shifts said retaining sleeve upwardly to permit said slip means to radially expand into engagement with the inner wall of said casing extension sleeve.

2. For use with a casing string having a tubular bottom element defining an upwardly facing shoulder and a seal bore above said shoulder, a float shoe unit comprising a tubular housing containing a float valve, means in said tubular housing defining a threaded connection to a tubular workstring, an external locating shoulder on said tubular housing engagable with said upwardly facing annular locating shoulder in said sleeve when said tubular housing is run in on a tubular workstring; an external annular seal on said tubular housing engagable with said seal bore, radially expandable slip means on said tubular housing above said external annular seal, a retaining sleeve for holding said slip means in a radially retracted position, and means connecting said retaining sleeve for axial co-movement with the tubular workstring, whereby rotation of the tubular workstring in the direction opposite the direction of the threads shifts said retaining sleeve upwardly to permit said slip means to radially expand into engagement with the inner wall of said bottom element.

3. The apparatus defined in claim 1 or 2 wherein said means in said tubular housing defining a threaded connection to a tubular workstring comprises an internally threaded inner sleeve rigidly secured within said tubular housing, a coupling attachable to a workstring and having an externally threaded portion engagable with said internally threaded inner sleeve, and means for securing said retaining sleeve to said coupling for axial comovement therewith.

4. The apparatus defined in claim 1, 2 or 3 wherein said slip means comprise a plurality of annular segment slips mounted in peripherally spaced relation in an annular external recess provided in said tubular housing, said annular recess having an inclined bottom surface operable to cam said slips radially outwardly by upward relative movement of said tubular housing.

5. The apparatus defined in claim 1, 2 or 3 wherein said tubular housing comprises an outer sleeve mounting said external annular seal, an annular recess in said outer sleeve above said external annular seal, said annular recess having an outwardly and downwardly inclined bottom surface, and said slip means comprise a plurality of annular segment slips mounted in said annular recess and having inclined bottom surfaces corresponding to said annular recess bottom surface, whereby upward relative movement of said outer sleeve and said slips will urge said slips radially outwardly.

6. The apparatus defined in claim 1 or 2 wherein said inner sleeve defines a reduced diameter seal bore below said internal thready to sealingly receive the end of a drill pipe inserted after removal of the workstring.

7. The method of installing a cementing float shoe in the bottom of a well casing comprising the steps of:

(1) providing in the bore of the well casing immediately above the desired location of the cementing float shoe a cylindrical seal bore surface and an upwardly facing locating shoulder;

(2) running in the well on a workstring a cementing float shoe having a downwardly facing external abutment surface adjacent an external annular seal, and radially expandable slips disposed above the external annular seal;

(3) engaging the external annular seal with the cylindrical seal bore surface and engaging the downwardly facing external abutment surface on the cementing float shoe with the upwardly facing locating shoulder;

(4) expanding the radially expandable slips into engagement with the adjacent inner wall of the casing by manipulation of the workstring;

(5) detaching the workstring from the cementing float shoe.

8. The method of installing a cementing float shoe in the bottom of a well casing comprising the steps of:

(1) providing in the bore of the well casing immediately above the desired location of the cementing float shoe a cylindrical seal bore surface and an upwardly facing locating shoulder;

(2) running in the well on a tubular workstring a cementing float shoe, the float shoe having a downwardly facing external abutment surface, an external annular seal engagable with the casing seal bore surface, and radially expandable slips located above the external annular seal;

(3) engaging the external annular seal surface of the cementing float shoe with the casing seal bore surface and seating the downwardly facing external abutment surface of the cementing float shoe on the upwardly facing locating shoulder in the casing;

(4) expanding the radially expandable slips into engagement with the adjacent inner wall of the casing in a position above the casing seal bore by rotating the tubular workstring to partially disengage the tubular workstring from the cementing float shoe;

(5) raising the cementing float shoe to wedge the slips into engagement with the casing wall; and (6) completing the rotation of the tubular workstring to detach same from the cementing float shoe and removing the workstring from the casing.

* * * * *